US005383520A

United States Patent [19]

Tucker et al.

[11] Patent Number: 5,383,520

[45] Date of Patent: Jan. 24, 1995

[54] COILED TUBING INFLATABLE PACKER WITH CIRCULATING PORT

[75] Inventors: James C. Tucker; Donald W. Winslow; Jeffrey S. Walter; Steven L. Schwegman, all of Duncan, Okla.

[73] Assignee: Halliburton Company, Duncan, Okla.

[21] Appl. No.: 949,592

[22] Filed: Sep. 22, 1992

[51] Int. Cl.[6] ..... E21B 33/127; E21B 34/10

[52] U.S. Cl. ..... 166/142; 166/186; 166/187; 166/191; 166/319

[58] Field of Search ..... 166/127, 187, 191, 183, 166/184, 185, 186, 319, 142

[56] References Cited

U.S. PATENT DOCUMENTS

| | | | |
|---|---|---|---|
| 2,824,612 | 2/1958 | Lynes | 166/187 X |
| 3,850,250 | 11/1974 | Holden et al. | 166/315 |
| 3,876,003 | 4/1975 | Kisling, III | 166/191 X |
| 3,930,540 | 1/1976 | Holden et al. | 166/315 |
| 3,970,147 | 7/1976 | Jessup et al. | 166/315 |
| 3,986,554 | 10/1976 | Nutter | 166/319 |
| 4,044,829 | 8/1977 | Jessup et al. | 166/264 |
| 4,058,165 | 11/1977 | Holden et al. | 166/314 |
| 4,063,593 | 12/1977 | Jessup | 166/317 |
| 4,064,937 | 12/1977 | Barrington | 166/162 |
| 4,113,012 | 9/1978 | Evans et al. | 166/264 |
| 4,246,964 | 1/1981 | Brandell | 166/106 |
| 4,311,197 | 1/1982 | Hushbeck | 166/373 |
| 4,324,293 | 4/1982 | Hushbeck | 166/317 |
| 4,424,860 | 1/1984 | McGill | 166/187 X |
| 4,445,571 | 5/1984 | Hushbeck | 166/317 |
| 4,513,764 | 4/1985 | Yonker | 166/319 X |
| 4,566,535 | 1/1986 | Sanford | 166/113 |
| 4,567,944 | 2/1986 | Zunkel et al. | 166/120 |
| 4,569,396 | 2/1986 | Brisco | 166/185 X |
| 4,633,952 | 1/1987 | Riggenberg | 166/336 |
| 4,657,082 | 4/1987 | Ringgenberg | 166/336 |
| 4,691,779 | 9/1987 | McMahan et al. | 166/321 |
| 4,768,590 | 9/1988 | Sanford et al. | 166/187 |
| 4,823,882 | 4/1989 | Stokley et al. | 166/387 |
| 4,856,583 | 8/1989 | Greenlee et al. | 166/127 |
| 4,962,815 | 10/1990 | Schultz et al. | 166/387 |
| 5,012,871 | 5/1991 | Pleasants et al. | 166/127 X |

FOREIGN PATENT DOCUMENTS

| | | | |
|---|---|---|---|
| 63519 | 10/1982 | European Pat. Off. | 166/319 |

OTHER PUBLICATIONS

Exhibit A—*Ocean Industry*, Feb., 1989, pp. 44 and 45, "Thru-tubing straddle packer expands, seals in casing".

Exhibit B—Tam International, 1980–1981 General Catalog.

Exhibit C—Tam International Ordering Guide, Jan., 1986.

Exhibit D—Brochure entitled TAM-J TM Heavy-Duty Inflatable Packers For Well Testing, Workovers, and Production, 1986.

Exhibit E—Lynes 1978–1979 Catalog, pp. 18–19 and 22–23.

*Primary Examiner*—Hoang C. Dang

*Attorney, Agent, or Firm*—Stephen R. Christian; Neal R. Kennedy

[57] ABSTRACT

A packer apparatus with a circulating port. A housing of the packer has inflation passages, circulating passages, treating fluid passages, and equalizing passages defined therein. In a straddle packer embodiment, upper and lower packers are mounted on the housing on opposite sides of an outlet of the treating fluid passage. A circulation valve with a sliding differential pressure actuated valve sleeve is disposed below the packers. An inner mandrel is slidably received in the central opening of the housing. The mandrel has a mandrel bore and has upper inflation and circulating ports, lower inflation ports, upper and lower equalizing ports, a treating port and lower circulating ports, all of which communicate with the mandrel bore. The valve sleeve has a valve port. A lug and endless J-slot is operably associated with the housing and mandrel for controlling a telescoping position of the mandrel relative to the housing in response to reciprocation without rotation of the mandrel relative to the housing. The mandrel may also be used to lock the valve sleeve in a closed position. The lug and J-slot define a repeatable sequence of inflating (or deflating) position, intermediate position, circulating position, treating position, equalizing position, and ready position wherein the tool is ready to return to the original inflating position on the next telescoping stroke of the mandrel within the housing.

25 Claims, 7 Drawing Sheets

COILED TUBING INFLATABLE PACKER WITH CIRCULATING PORT

BACKGROUND OF THE INVENTION

1. Field Of The Invention

The present invention relates generally to packer apparatus for isolating a zone of a well, and more particularly, but not by way of limitation, to packer apparatus capable of being lowered through a production tubing on coiled tubing while circulating fluid through a circulating valve, and then inflated adjacent to a zone of a production casing for treatment of the zone without the need for pulling the production tubing from the well. Circulation may also be carried out above the set packer.

2. Description Of The Prior Art

During the life of an oil or gas well, it is often desirable to perform treating operations on some subsurface zone of the well. The cost involved in performing treating operations on completed wells which require the removal of production tubing is often very high. This is especially true when a well is located in a remote area such as the North Slope of Alaska where a rig must be moved back over the well in order to perform operations. Many of these wells located on the North Slope of Alaska are equipped with large tubing strings, e.g., four and one-half or five and one-half inch tubing, production packers and gas lift valves. This high workover cost creates the need for tools which can be run on small diameter coiled tubing and can pass through production tubing and other equipment and then expand out to seal off intervals inside the production casing for treating or other operations.

The prior art presently includes several packer apparatus, such as straddle packers, which can be utilized in the general manner described above. A first such device is being marketed by Nowsco Well Service Ltd. of Aberdeen, Scotland, as described in an *Ocean Industry* article dated February, 1989, entitled "Thru-Tubing Straddle Packer Expands, Seals in Casing" at pages 44–45. That apparatus is lowered into the well while circulating fluid down through the coiled tubing and out a dump sub. After the tool is located at the appropriate position in the well, the pumping rate down the coiled tubing is increased and the dump sub closes, thus directing fluid to the packers to inflate the packers. Weight is then set down on the apparatus to close the inflation ports and open the treating ports. After treatment is completed, picking up weight reopens the packer inflation ports and allows the packers to deflate. The tool can then be relocated and recycled to treat another zone.

Another inflatable straddle packer is marketed by Tam International of Houston, Tex., as disclosed in the Tam International 1980–1981 *General Catalog* under the heading "Inflatable Perforation Wash Tool". The Tam International inflatable perforation wash tool can be run on coiled tubing. A ball is dropped to seal the mandrel of the tool prior to inflation of the packers. Weight is then set down on the tool to close the inflation ports and open the circulating or treating ports. After treatment, weight is picked up to deflate the packers and unseat the tool.

U. S. Pat. No. 4,648,448 to Sanford et al., and assigned to Tam International, Inc., of Houston, Tex., discloses another straddle packer apparatus. The apparatus disclosed in the '448 patent utilizes a lug and J-slot structure which is actuated by a combination of reciprocation and rotation of a rigid tubing string on which the tool is lowered. When run on a rigid tubing string, so that the tool can be rotated to actuate the J-slot mechanism, it does not appear that this apparatus could be run through production tubing and set in production casing below the production tubing. A Tam International advertising brochure entitled "Tam-J TM Inflatable Workover/Testing Packers And Accessories Ordering Guide" dated January, 1986, indicates at page 5 thereof under the heading "Coil-Tubing Operations" that smaller diameter Tam-J TM packers can be utilized on continuous coil tubing by removing the lugs from the J-slot mechanism and allowing the tool to be set, released and reset with straight up and down movement of the coil tubing. Thus, the J-slot mechanism is in effect eliminated from this straddle packer apparatus when it is utilized with coil tubing, which cannot be rotated.

All of the devices discussed above which are designed to be run on coiled tubing down through production tubing and then set in production casing are limited in their operating flexibility since they only have two operating positions which are achieved by either setting down weight or picking up weight. These tools are run into the well with their inflating ports in an open position, and after being located at the appropriate elevation in the well, the packers are inflated to seal them against the casing. Weight is then set down on the packers to close the inflation ports and open a treating port between the packers. Subsequently, weight is picked up from the apparatus to close the treating ports and reopen the inflation ports thus allowing the packers to deflate.

U.S. Pat. No. 4,962,815 to Schultz et al., assigned to the assignee of the present invention, discloses an improved straddle packer apparatus designed to be lowered on coiled tubing down through production tubing and then set in production casing located below the production tubing. A lug and endless J-slot mechanism in this packer provides more than two different operating positions of the tool in response to simple vertical reciprocation of the coiled tubing without rotation thereof. This is accomplished by mounting either the lug or the J-slot in a rotatable body mounted within the packer apparatus. Thus, a simple reciprocating motion without rotation of the coiled tubing can be translated into a multitude of operating positions of the tool as defined by the pattern of the J-slot. The dropping of balls is not necessary.

One particular operating position in the straddle packer of Schultz et al. is an equalizing position. In the equalizing position, the sealed zone of the well located between the inflated packers is communicated with the well annulus both above and below the packers so as to equalize pressures across the packers prior to deflating the packers. This makes it much easier to release the packers, and prevents damage to the packers, thus assuring that multiple settings of the straddle packer apparatus can be accomplished.

The inflatable straddle packer of the '815 patent works well, but in some cases it is desirable to be able to circulate or spot fluids in the well before treating the formation. This is not possible with this prior packer which has no provisions for circulating fluids. The present invention solves this problem by improving the '815 apparatus to include a circulation valve for circulating fluids as the packer is run into the well and also providing a circulating position in which a circulating port above the tool is opened after the inflatable packing elements have been set. The circulating valve may also act as a fill-up valve when the packer is run into the well without a check valve in the tubing string.

There is also a problem of deflating the packer elements of such inflatable straddle packers when the packer is run in a tubing string which has a check valve above the packer. In the present invention, the circulation valve allows venting of fluid to the well annulus so the packer elements will deflate.

Summary of the Invention

Many of the components of the inflatable straddle packer embodiment of the present invention are substantially identical to that shown in the above referenced U.S. Pat. No. 4,962,815 to Schultz et al. Accordingly, a copy of U.S. Pat. No. 4,962,815 is incorporated herein by reference.

A circulating valve is included in the present invention as a first circulating means for allowing circulation of fluid as the tool is run into the well bore. The circulating valve is closed for inflating the packer element or elements and during testing and equalizing operations. A second circulating means is included as an integral part of the packer for allowing circulation of fluid in the well after the packer elements have been set. The second circulating means comprises a circulating position added to the J-slot of the prior packer and is resettable. Setting the packer in any of its positions is carried out without rotation of the coiled tubing. That is, as with the earlier packer, the present invention may be operated with only simple reciprocation.

More particularly, the first circulating means comprises a housing defining a circulating passage therethrough and a valve sleeve slidably disposed in the housing. The valve sleeve defines a valve port therethrough in communication with the circulating passage when the valve sleeve is in an open position, thereby allowing circulation, and isolated from the valve port when in a closed position, thereby preventing circulation. A biasing means, such as a spring, is provided for biasing the sleeve toward the open position. The valve sleeve defines a differential area thereon, and a predetermined fluid flow rate through the apparatus results in sufficient pressure acting across the differential area to move the valve sleeve to the closed position for inflation, circulating through the second circulating means, treating and equalizing.

A means is provided for holding or locking the valve sleeve in the closed position during other operations of the tool. In the illustrated embodiment, this means for holding is characterized by a radial flange on a mandrel of the inflatable packer, wherein the flange is adapted for engaging the valve sleeve and holding it in the closed position.

The second circulating means is characterized by a circulating port defined in the mandrel and a circulating passage defined in the housing of the inflatable packer. The circulating port and circulating passage are in communication with one another when the mandrel is in a circulating position with respect to the housing.

Further, the packer apparatus comprises a housing having a central opening, and having packer inflation passage means defined in the housing. The housing also has a treating fluid passage defined in the housing with an outlet of the treating fluid passage communicating with an exterior of the housing.

In the straddle packer embodiment, upper and lower longitudinally spaced packer elements are mounted on the housing on opposite sides of the outlet. These packer elements are in communication with the packer inflation passage means. However, the invention is not intended to be limited to a straddle packer, and a single packer element may be used.

An inner mandrel is slidably received in the central housing opening, and the mandrel has a mandrel bore having an inflation port means and a treating port means, each communicated with the mandrel bore.

The housing also has an equalizing passage means defined therein communicated with an exterior of the housing above the upper packer and communicated with the housing below the lower packer. The mandrel has equalizing port means defined thereon in communication with the mandrel bore.

A lug and J-slot means is operably associated with the housing and the inner mandrel for controlling a telescoping position of the mandrel relative to the housing in response to telescoping reciprocation without rotation of the mandrel relative to the housing. The mandrel is movable between an inflating position, an intermediate position, a circulating position, a treating position, an equalizing position, and a ready position wherein the mandrel is positioned to return to the inflating position so that the cycle can be repeated any number of times.

The J-slot is preferably defined on the mandrel, and the lug which is received in the J-slot is preferably defined on a rotating body mounted in the housing so as to permit relative rotational motion between the lug and the J-slot about a longitudinal axis of the housing without having relative rotational movement between the mandrel and the housing itself.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
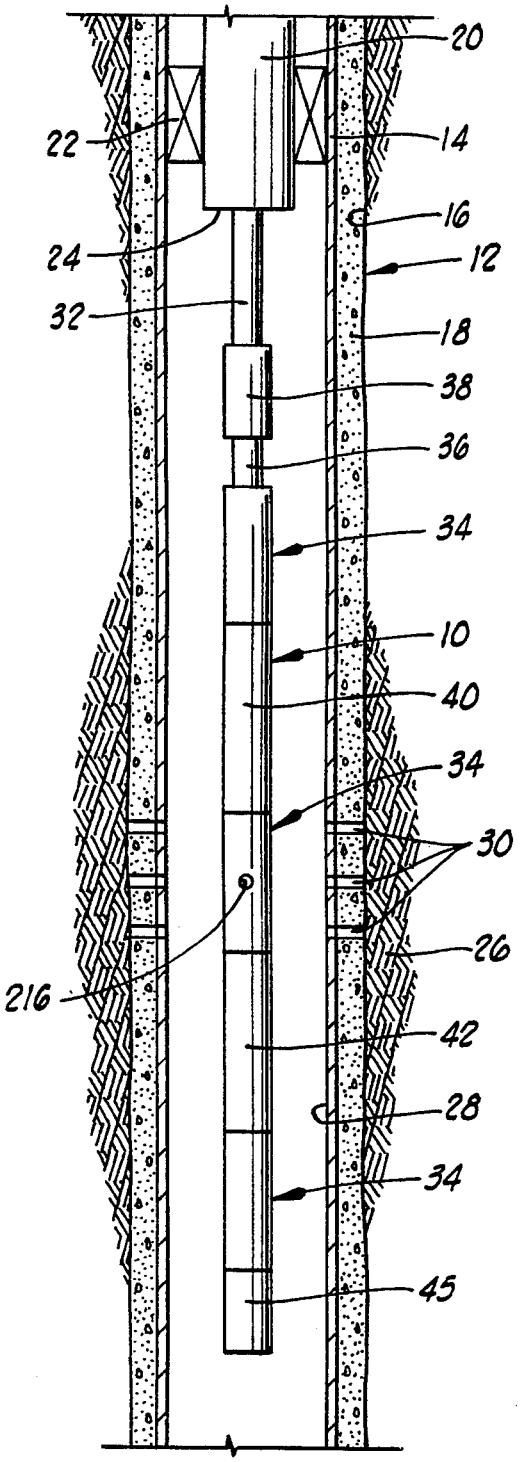
FIG. 1 is a schematic elevation view of the coiled tubing packer with circulating port apparatus of the present invention being lowered into place adjacent a subsurface zone of a production well. The packer apparatus has been lowered through a production tubing and is located in the production casing below the lower end of the production tubing.
Figure 2:
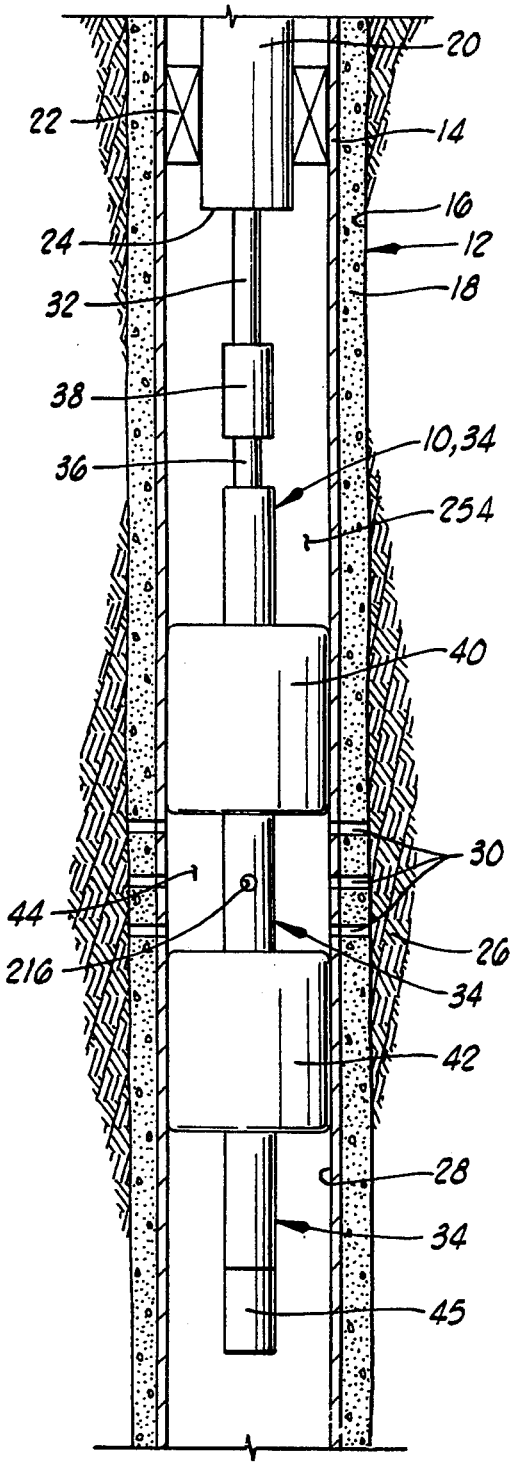
FIG. 2 is a schematic elevation view similar to FIG. 1, showing the packer inflated to isolate the subsurface zone of the well which is to be treated.

Referring now to the drawings, and particularly to FIGS. 1 and 2, the packer apparatus is thereshown in a schematic elevation view in place in a well. The embodiment shown is a straddle packer apparatus which is generally designated by the numeral 10. The invention is not intended to be limited to a straddle packer embodiment, however, and may be characterized as an apparatus with a single packer element. The packer 10 is shown in FIG. 1 after it has been lowered into a well generally designated by the numeral 12. The well 12 includes a production casing 14 cemented in place within a bore hole 16 by cement 18. A production tubing 20 is located within the casing 14 and has a packer 22 sealing the annulus between production tubing 20 and production casing 14. The production tubing has a lower end 24. As is apparent in FIG. 1, the production casing 14 extends downward below the lower end 24 of production tubing 20. The well 12 intersects a subsurface formation 26, and an interior 28 of production casing 14 is communicated with the formation 26 through a plurality of perforations 30.

In FIG. 1, the packer apparatus 10 has been lowered on a length of coiled tubing 32 into position adjacent the subsurface formation 26. The "coiled tubing" 32 is a relatively flexible tubing which can be coiled on a large reel and brought to the well site, where it is uncoiled to lower tools into the well without the use of a rig.

The packer apparatus 10 includes a housing generally designated by the numeral 34, with an inner mandrel 36 slidably received in the housing. A connecting means 38 connects the upper end of the mandrel 36, and thus connects the housing 34, to the coiled tubing 32 and communicates the inner bore of the coiled tubing 32 with the interiors of the mandrel 36 and the housing 34.

Figures 3A, 3B, 3C:
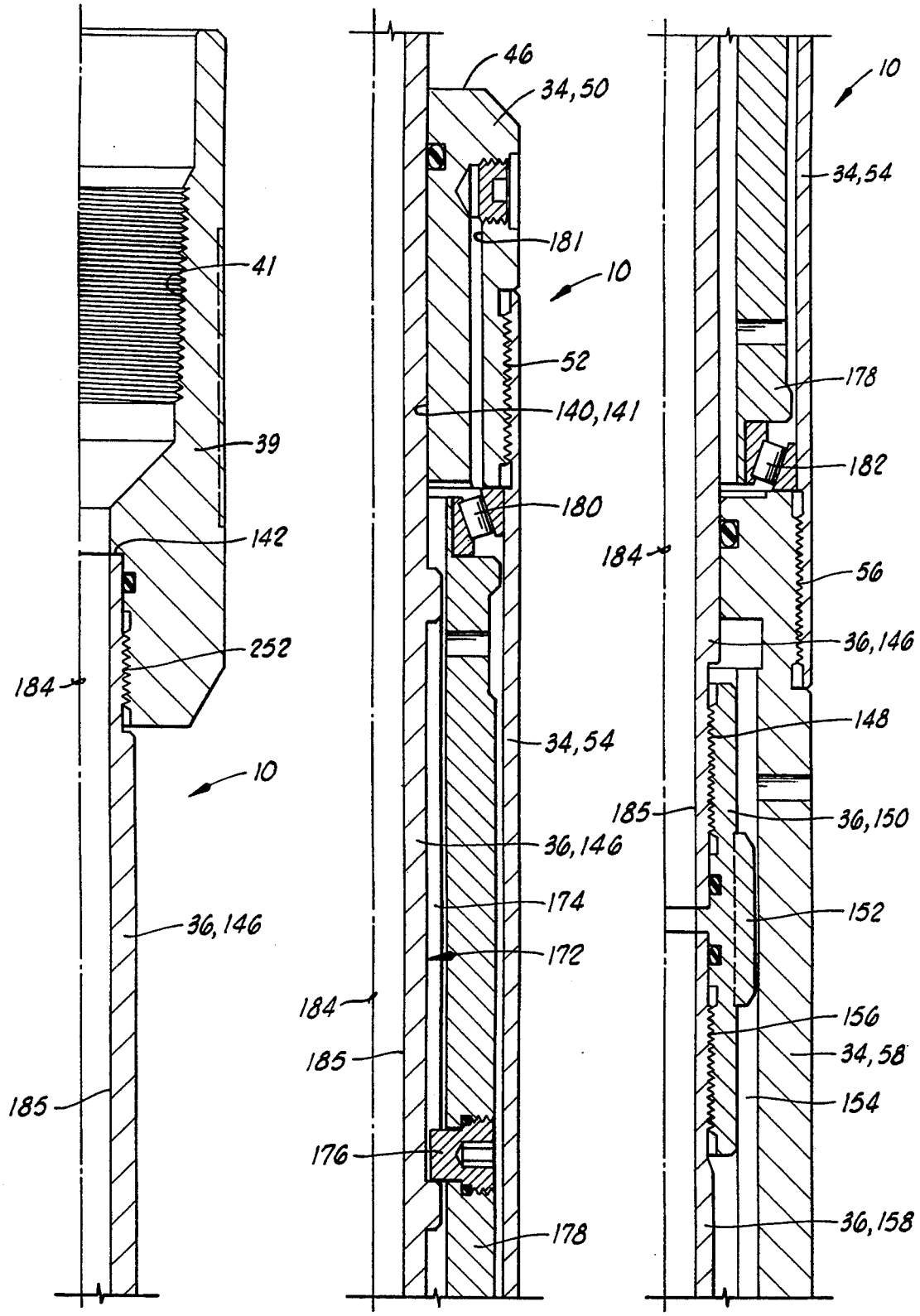
FIG. 3A–3P comprise an elevation right side only sectioned view of the packer apparatus of the present invention. The apparatus is in an inflating position, but the packers have not yet been inflated.

Referring also to FIG. 3A, an upper adapter 39 is connected to the upper end of mandrel 36 at a threaded connection 252. Upper adapter 39 has a threaded opening 41 adapted for connection to releasable connecting means 38. The releasable connecting means 38 can be of any one of many available designs. Preferably, it provides a means for releasing the connection in the event the apparatus 10 gets stuck in a well, so that the coiled tubing 32 can be retrieved, and then a fishing line or the like can be utilized to attempt to remove the stuck apparatus 10. The releasable connecting means 38 can be generally referred to as an upper connecting means 38 operably associated with both the mandrel 36 and the housing 34 for connecting the housing 34 to the coiled tubing 32 and for communicating an interior of the housing 34 and of the mandrel 36 with the bore of the coiled tubing 32. Furthermore, the upper adapter 39 and threads 252 on the upper end of mandrel 36 can themselves be generally referred to as an upper connecting means for connecting the mandrel 36 and the housing 34 to the tubing string 32 and for communicating the interior of the housing 34 and of the mandrel 36 with the bore of tubing string 32.

In the illustrated straddle packer embodiment, upper and lower inflatable packers or packer elements 40 and 42 are mounted on the housing 34. As seen in FIG. 2, the upper and lower inflatable packers 40 and 42 can be inflated to seal against the well casing 14 to isolate a zone 44 of the well. In a single packer element embodiment, only inflatable packer 40 is used and will generally be disposed above formation 26 of the well. For the purposes of this disclosure, the straddle packer embodiment will be discussed primarily.

At the lower end of housing 34 is a circulating valve 45. As will be further discussed herein, the outer components of circulating valve 45 form a portion of housing 34. Circulating valve 45 also allows packer elements 40 and 42 to be deflated and therefore may also be referred to as a deflation valve 45.

In a typical well for which the straddle packer apparatus 10 has been designed, such as many of the wells encountered on the North Slope of Alaska, the production tubing 20 is relatively large tubing, typically either four and one-half or five and one-half inch nominal diameter. The production casing 14 will typically be seven inch nominal diameter casing.

Straddle packer apparatus 10 can be run down through the production tubing 20 and then its packers 40 and 42 can be inflated to effectively seal against the interior 28 of production casing 14.

Figures 3D, 3E, 3F:
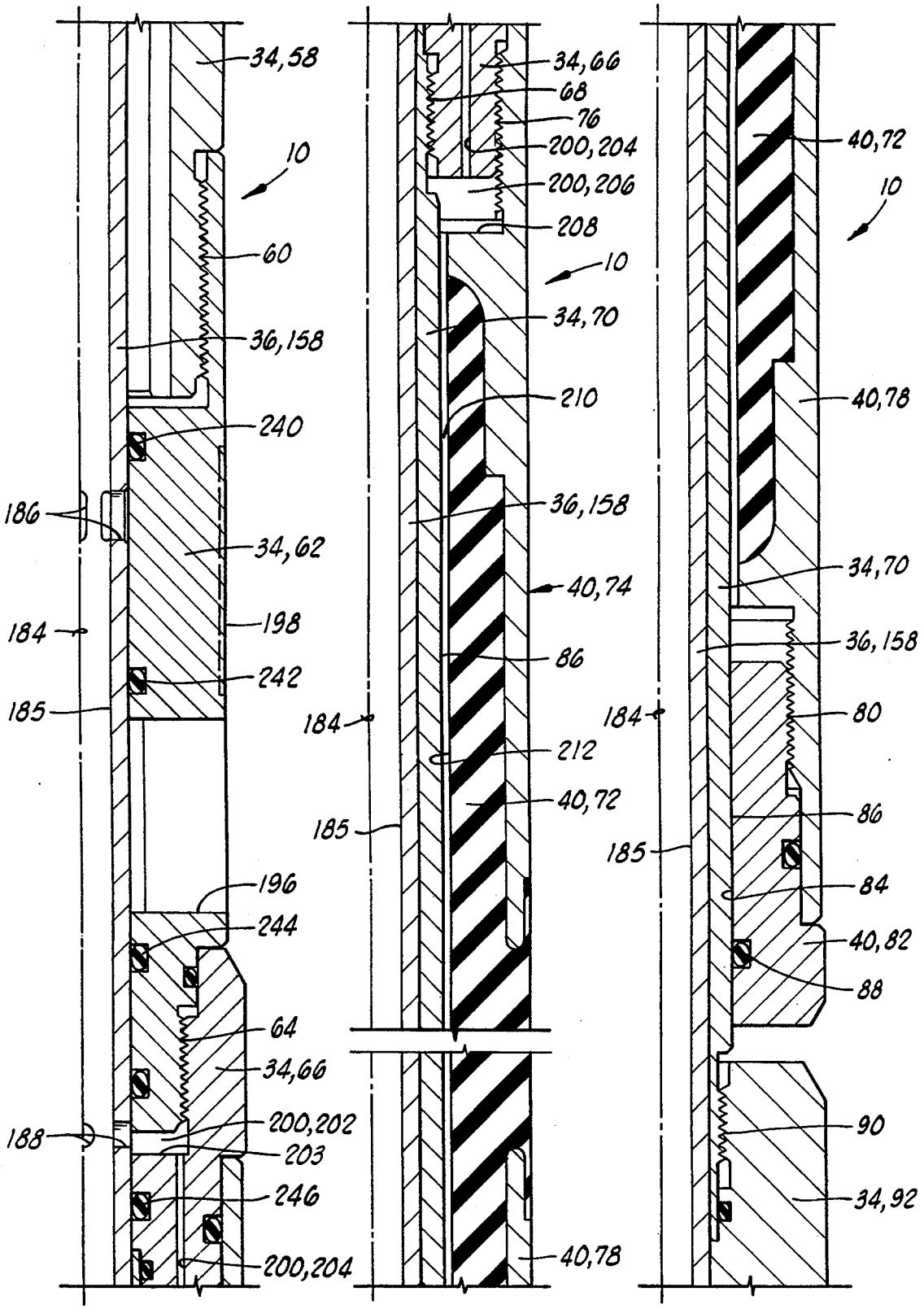
Figures 3G, 3H, 3I:
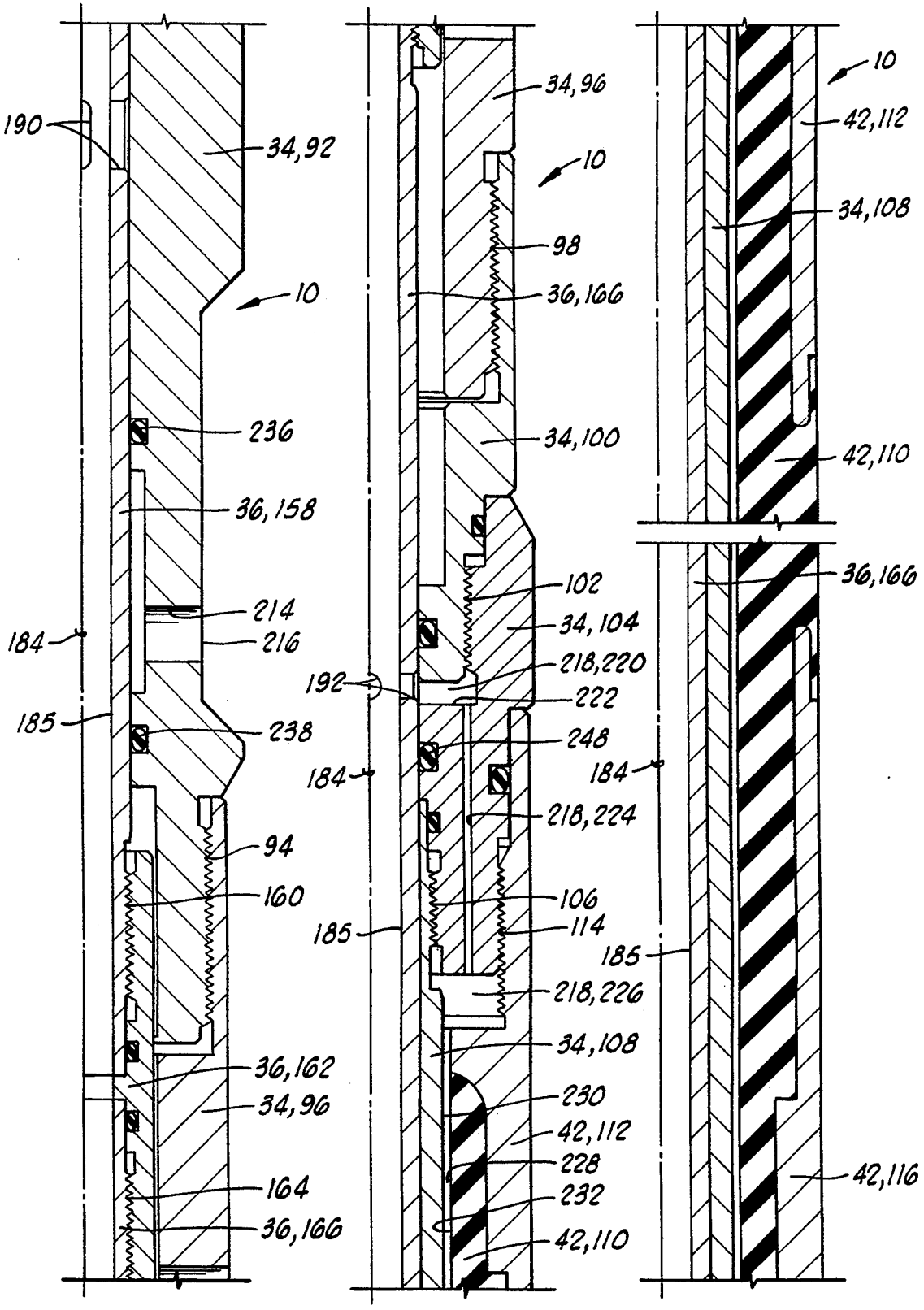
Figures 3J, 3K, 3L:
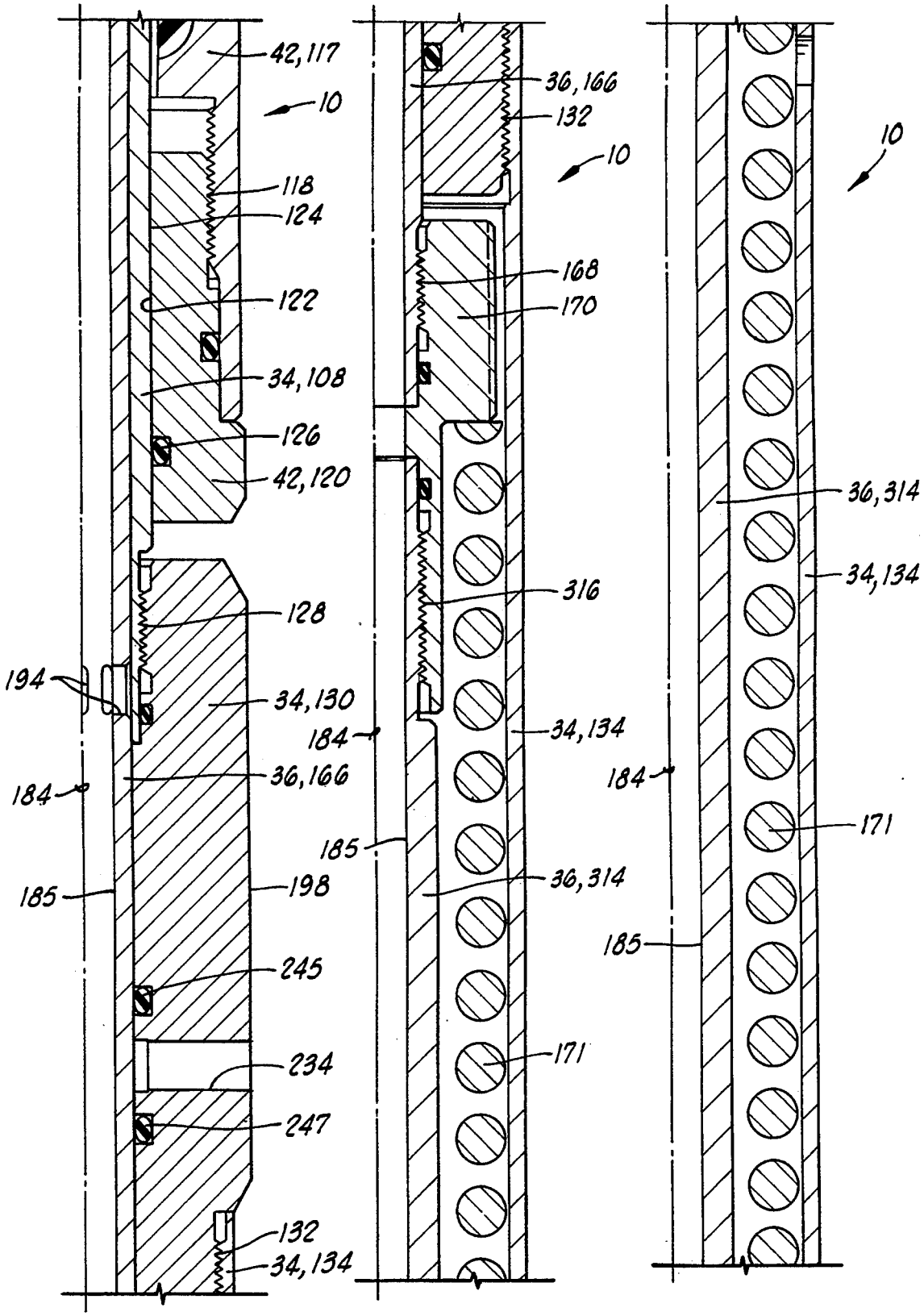
Figures 3M, 3N, 3P:
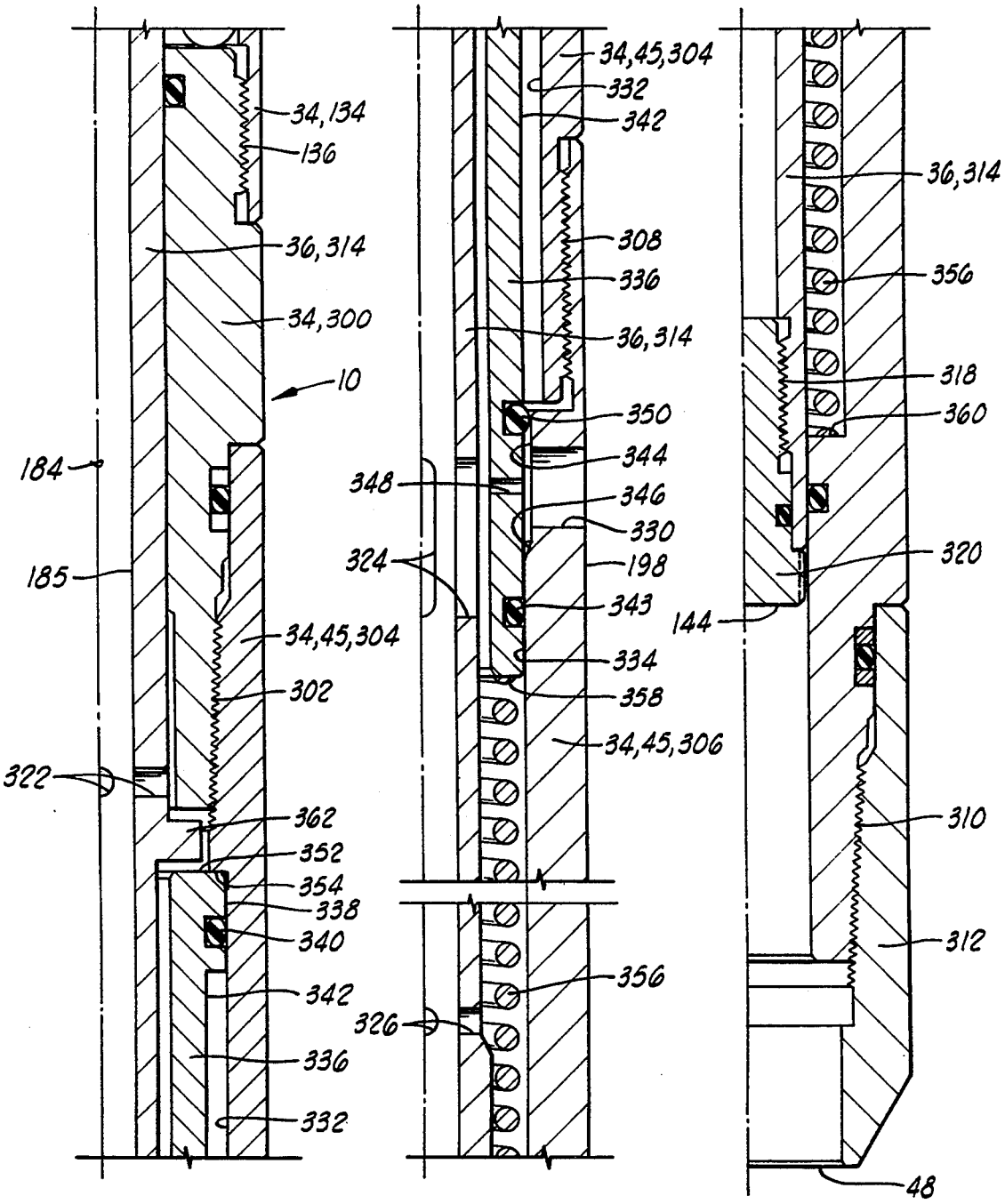

Turning now to FIGS. 3A–3P, the details of construction of the straddle packer apparatus 10 will be described.

The housing 34 has an upper end 46 and a lower end 48. Housing 34 is made up of a plurality of connected segments as follows, beginning at the upper end 46 in FIG. 3A.

Housing 34 includes an upper end section 50, threadedly connected at 52 to a bearing housing section 54. A lower end of bearing housing section 54 is threadedly connected at 56 to a splined housing section 58. A lower end of splined housing section 58 is connected at threaded connection 60 to upper equalizing housing section 62.

A lower end of upper equalizing housing section 62 is connected at threaded connection 64 to an upper inflation housing section 66. A lower end of upper inflation housing section 66 is connected at an internal thread 68 to an upper packer housing section 70.

The upper packer 40 includes an elastomeric inflatable element 72 having an annular upper packer ring 74 at its upper end which is threadedly and thus fixedly connected to upper inflation housing section 66 at threaded connection 76. At its lower end, the packer 40 has a lower packer ring 78 threadedly connected at 80 to a sliding lower packer shoe 82. Packer element 72, upper packer ring 74 and lower packer ring 78 form an assembly which is known in the art and available from an outside source. The exact configuration of packer element 72, upper packer ring 74 and lower packer ring 78 may vary from the embodiment illustrated.

The lower packer shoe 82 has an inside bore 84 closely and slidably received on an outer cylindrical surface 86 of upper packer housing section 70 with a sliding O-ring seal 88 provided therebetween.

Continuing with the description of housing 34, the lower end of upper packer housing section 70 is connected at threaded connection 90 to a treating housing section 92. The lower end of treating housing section 92 is connected at threaded connection 94 to an extension case housing section 96, which is in turn connected at threaded connection 98 to an adapter housing section 100. The adapter housing section 100 is connected at threaded connection 102 to a lower inflation housing section 104, which is in turn connected at internal thread 106 to a lower packer housing section 108.

The lower packer 42 includes an inflatable element 110 having an upper packer ring 112 attached thereto which is threadedly and fixedly connected at threaded connection 114 to the lower inflation housing section 104. The inflatable element 110 has a lower packer ring 116 attached thereto which is threadedly connected at 118 to a lower annular sliding packer shoe 120. Packer element 110, upper packer ring 112 and lower packer ring 116 form an assembly substantially identical to that associated with upper packer 40. Thus, packer element 110, upper packer ring 112 and lower packer ring 116 are available in an assembly from an outside source, and the exact configuration thereof may vary.

Shoe 120 has a cylindrical inner bore 122 which is closely and slidably received about the cylindrical outer surface 124 of lower packer housing section 108 with a sliding O-ring seal 126 being provided therebetween.

Continuing with the description of housing 34, the lower packer housing section 108 has its lower end threadedly connected at 128 to a lower equalizing housing section 130.

It should be noted at this point that in an embodiment of packer 10 which is not a straddle packer, lower packer 42 may be omitted from the apparatus, with the length of housing 42 and mandrel 36 being correspondingly shortened. Thus, in a single packer embodiment, the apparatus would include only upper packer 40 in addition to treating housing section 92 and extension case housing section 96. An adapter housing section, similar to adapter housing section 100, would also be used and would be threadingly connected to lower equalizing housing section 130. The exact configuration of the components may vary from those shown from the straddle packer embodiment, but those skilled in the art will understand that the apparatus may be made with lower packer 42 omitted.

Lower equalizing housing section 130 is threadedly connected at 132 to a spring housing section 134. The spring housing section 134 has its lower end connected at threaded connection 136 to a valve connector 300 which in turn is connected at threaded connection 302 to a valve adapter section 304 of circulation valve 45. The valve adapter 304 is connected at its lower end to a valve case section 306 by threaded connection 308. The Valve case 306 has its lower end connected at threaded connection 310 to bottom adapter section 312.

The upper end section 50 of housing 34 has an inner bore 140 which defines the upper end of a central housing opening generally designated as 141.

The inner mandrel 36 is slidably received within the central housing opening 141. Mandrel 36 has an upper end 142 (see FIG. 3A) and a lower end 144 (see FIG. 3P). The mandrel 36 is made up of several interconnected segments as follows, beginning at upper end 142. Mandrel 36 includes an upper mandrel section 146, the upper end of which is connected to upper adapter 39 at threaded connection 252, as previously discussed. The lower end of upper mandrel section 146 is threadedly connected at 148 to a splined mandrel coupling 150. Splined mandrel coupling 150 includes a plurality of radially outward extending splines 152 which mesh with a plurality of radially inwardly extending splines 154 of splined housing section 58 so as to prevent rotational motion between mandrel 36 and housing 34.

Splined mandrel coupling 150 is connected at threaded connection 156 to an intermediate mandrel section 158, which in turn has its lower end threadedly connected at 160 to a replaceable mandrel extension coupling 162. The mandrel extension coupling 162 is connected at threaded connection 164 to a lower mandrel section 166 which is connected at threaded connection 168 to a mandrel connector 170. Of course, in a single packer embodiment, lower mandrel section 162 is shorter.

The lower end of mandrel connector 170 is attached to a valve mandrel section 314 at threaded connection 316. The lower end of valve mandrel section 314 is attached at threaded connection 318 to a bottom plug section 320.

A spring biasing means 171, which is a coiled compression spring, is located within spring housing section 134 and held between the mandrel connector 170 and the valve connector 300 for biasing the mandrel 36 telescopingly outward, i.e., upward in FIGS. 3A–3P, relative to the housing 34.

The mandrel 36 telescopes between several positions relative to the housing 34. This telescoping movement of mandrel 36 relative to housing 34 is controlled by a lug and J-slot means generally designated by the numeral 172 (see FIGS. 3B and 4) which is operably associated with the housing 34 and inner mandrel 36 for controlling a telescoping position of the mandrel 36 relative to the housing 34 in response to telescoping reciprocation without rotation of the mandrel 36 relative to the housing 34. The lug and J-slot means 172 includes a J-slot 174 defined in the upper mandrel section 146, and includes a lug 176 carried by the housing 34 and received in the slot 174 to define a repeatable pattern of telescopingly reciprocating movement of the mandrel 36 relative to the housing 34.

The lug 176 is defined on a rotating body 178 which is rotatingly mounted in upper and lower bearings 180 and 182 within the bearing housing section 54 of housing 34. Thus, as the mandrel 36 reciprocates relative to the housing 34, the rotating body 178 and its attached lug 176 can freely rotate about a longitudinal axis 184 of housing 34 without having relative rotational motion between the mandrel 36 and housing 34. As previously indicated, the mandrel 36 and housing 34 are splined together by splines 152 and 154, thus preventing any rotational motion between the mandrel 36 and housing 34. A lubricating passage 181 is defined in upper housing section 50 for lubricating bearings 180 and 182.

The spacing between upper and lower packers 40 and 42 in the straddle packer embodiment is defined by the dimensions of the housing 34 upon which they are mounted. This spacing can be adjusted by removing replaceable mandrel extension coupling 162 of mandrel 36 and the replaceable extension case housing section 96 of housing 34 and replacing them with analogous items of different lengths with similar upper and lower end connections.

The housing 34 has a plurality of passages defined therethrough, and the mandrel 36 has a plurality of ports defined therethrough communicating with a mandrel bore 185. The various operating positions of the packer apparatus 10, as defined by the lug and J-slot means 172, serve to appropriately align the various ports of mandrel 36 with the various passages of housing 34 to provide the desired functions from the packer apparatus 10. These various ports and passages will first be identified, and then the various operating positions of the packer apparatus 10 can be accurately described.

The various ports in the mandrel 36 will first be described, starting from its upper end 142.

The intermediate mandrel section 158 has a plurality of upper equalizing and circulating ports 186 (see FIG. 3D) defined therethrough. A short distance below the upper equalizing and circulating ports 186, a plurality of upper inflation ports 188 (see FIG. 3D) are found. Near the lower end of intermediate mandrel section 158, a plurality of treating ports 190 (see FIG. 3G) are defined.

The lower mandrel section 166 includes a plurality of lower inflation ports 192 (see FIG. 3H) defined therethrough. Near the lower end of lower mandrel section 166, there are a plurality of lower equalizing ports 194 (see FIG. 3J).

The upper and lower equalizing ports 186 and 194 can be jointly referred to as an equalizing port means 186, 194. The upper and lower inflation ports 188 and 192 can be jointly referred to as an inflation port means 188, 192.

The valve mandrel section 314 has a plurality of upper fluid relief ports 322 (see FIG. 3M) defined therethrough. Below upper fluid relief ports 322, a plurality of lower circulating ports 324 (see FIG. 3N) are defined in valve mandrel section 314. Below lower circulating ports 324, valve mandrel section 314 defines a plurality of lower fluid relief ports 326 therethrough (see FIG. 3N).

Turning now to the various passages defined within the housing 34, an upper equalizing and circulating passage 196 (see FIG. 3D) is defined through upper equalizing housing section 62 and communicates with an exterior surface 198 of the housing 34 above upper packer 40. There are in fact a plurality of radially oriented upper equalizing passages 196 spaced around the circumference of upper equalizing housing section 62.

The upper circulating ports 186 and upper circulating passages 196 can be jointly referred to as an upper circulating means 186, 196.

An upper inflation passage 200 (see FIGS. 3D and 3E) begins with an annular space 202 defined between the lower end of upper equalizing housing section 62 and an upward facing shoulder 203 of upper inflation housing section 66. Upper inflation passage 200 continues with a plurality of longitudinal bores 204, only one of which is visible in FIGS. 3D and 3E, extending to the lower end of upper inflation housing section 66. The longitudinal bores 204 communicate with an annular space 206 defined between the lower end of upper inflation housing section 66 and an upward facing shoulder 208 of upper packer ring 74 of upper inflatable packer 40. The upper inflation passage 200 finally includes a long thin annular space 210 defined between the outer surface 86 of upper packer housing section 70 and an inside diameter 212 of the inflatable element 72 of upper packer 40. The lower end of upper inflation passage 200 is defined by the sliding seal 88 which seals between lower packer shoe 82 and upper packer housing section 70.

A treating fluid passage 214 (see FIG. 3G) is defined as a substantially radial bore through the wall of treating housing section 92 and has an outlet 216. There are in fact a plurality of such radially extending treating fluid passages 214 distributed around the circumference of treating housing section 92.

The housing 34 also has a lower inflation passage 218 (see FIG. 3H) defined therein. Lower inflation passage 218 begins with an annular space 220 defined between the lower end of adapter housing section 100 and an upward facing shoulder 222 of lower inflation housing section 104. Lower inflation passage 218 continues with a plurality of longitudinal bores 224 extending downward through lower inflation housing section 104 to a lower end thereof where they are communicated with an annular space 226 which in turn communicates with a long thin annular space 228 defined between an outer surface 230 of lower packer housing section 108, and an inside diameter 232 of the inflatable element 110 of lower packer 42. The lower extremity of lower inflation passage 218 is defined by the sliding seal 126 which seals between lower packer shoe 120 and the lower packer housing section 108.

The lower equalizing housing section 130 of housing 34 has a lower equalizing passage 234 (see FIG. 3J) defined therethrough. There are in fact a plurality of such lower equalizing passages 234 spaced around the circumference of the lower equalizing housing section 130. Passages 234 communicate with the exterior 198 of housing 34 below lower packer 42.

The upper inflation passage 200 and the lower inflation passage 218 can be jointly referred to as an inflation passage means 200, 218 defined in the housing 34.

The upper equalizing passages 196 and the lower equalizing passages 234 can be jointly referred to as an equalizing passage means 196, 234 defined in the housing 34.

Finally, valve case section 306 of housing 34 has a plurality of lower circulating passages 330 (see FIG. 3N) defined therethrough. Lower circulating passages 330 communicate with the exterior 198 of housing 34.

Referring now to FIGS. 3M–3P, additional details of circulation valve 45 will be discussed. Valve adapter 304 has a bore 332 therein, and valve case 306 has a coaxial bore 334 therein which is somewhat smaller than bore 332. A valve sleeve 336 is slidably disposed in valve adapter 304 and valve case 306. The upper end of valve sleeve 336 has a first outer surface 338 which is adapted for sliding within bore 332 in valve adapter 304. An upper seal 340 provides sealing between the upper end of valve sleeve 336 and valve adapter 304. Valve sleeve 336 also has a second outer surface 342 which is smaller than first outer surface 338. Second outer surface 342 is adapted to slide within bore 334 in valve case 306. A lower seal 343 is provided for sealing between valve sleeve 336 and valve case 306 below lower circulating passage 330.

At the upper end of bore 334 in valve case 306, a counterbore 344 is defined and is in communication with lower circulating passage 330. At the lower end of counterbore 344 is a chamfer 346.

Valve sleeve 336 defines a plurality of valve ports 348 therethrough which are initially generally longitudinally aligned with lower circulating passages 330 in valve case 306 and are initially in communication with bore 185 in mandrel 36 through lower circulating ports 324. Above valve ports 348, valve sleeve 336 carries an intermediate seal 350. Initially, intermediate seal 350 is not engaged with valve case 306.

The lower circulating passages 330, the valve ports 348 and the lower circulating ports 324 can be jointly referred to as a lower circulating means 324, 348, 330.

Upward movement of valve sleeve 336 is limited by engagement of upper end 352 of the valve sleeve with a shoulder 354 in valve adapter 304.

A valve spring 356 is disposed in valve case 306 between lower end 358 of valve sleeve 336 and a shoulder 360 in valve case 306. Spring 356 acts as a biasing means for biasing valve sleeve 336 upwardly toward shoulder 354 in valve adapter 304.

A radially outwardly extending flange 362 (see FIG. 3M) is formed on valve mandrel section 314. Flange 362 is disposed above upper end 352 of valve sleeve 336 and below upper fluid relief ports 322 in valve mandrel 314. It will be seen that as valve mandrel 314 is moved downwardly, it will engage upper end 352 of valve sleeve 336 to displace the valve sleeve downwardly.

The straddle packer apparatus 10 as shown in FIGS. 3A–3P is shown in a first circulating position wherein fluid may be circulated through circulating means 324, 348, 330. That is, valve sleeve 336 in circulation valve 45 is in an open position. This same position is also used when deflating packers 40 and 42, as will be further described herein. Therefore, FIGS. 3A–3P also illustrate a deflating position. As will also be described herein, when circulation valve 45 is closed, with all of the other components of straddle packer apparatus 10 in the position shown in FIGS. 3A–3P, this corresponds to an inflating position of the packer apparatus. In other words, with the exception of the position of valve sleeve 336, FIGS. 3A–3P also illustrate the components of packer 10 in the inflating position. Therefore, FIGS. 3A–3P may be referred to herein as referring to a first circulating position, inflating position, circulating/inflating position, or deflating position.

In the inflating position, the upper and lower inflation ports 188 and 192 of mandrel 36 are communicated with the upper and lower inflation passages 200 and 218 of housing 34, so that inflation fluid can be pumped down through the coiled tubing 32, and through the mandrel bore 185 then through the inflation ports 188 and 192 and through the inflation passages 200 and 218 to inflate the packers 40 and 42 as schematically illustrated in FIG. 2.

In the inflating position of the packer apparatus 10 as shown in FIGS. 3A–3P, the treating ports 190 of mandrel 36 are isolated from the treating fluid passages 214 of housing 34 by O-rings 236 and 238.

Also, in the inflating position, the upper equalizing passages 196 are isolated from the upper equalizing ports 186 by O-rings 240, 242 and 244 and the lower equalizing passages 234 are isolated from the lower equalizing ports 194 by O-rings 245 and 247.

Figure 4:
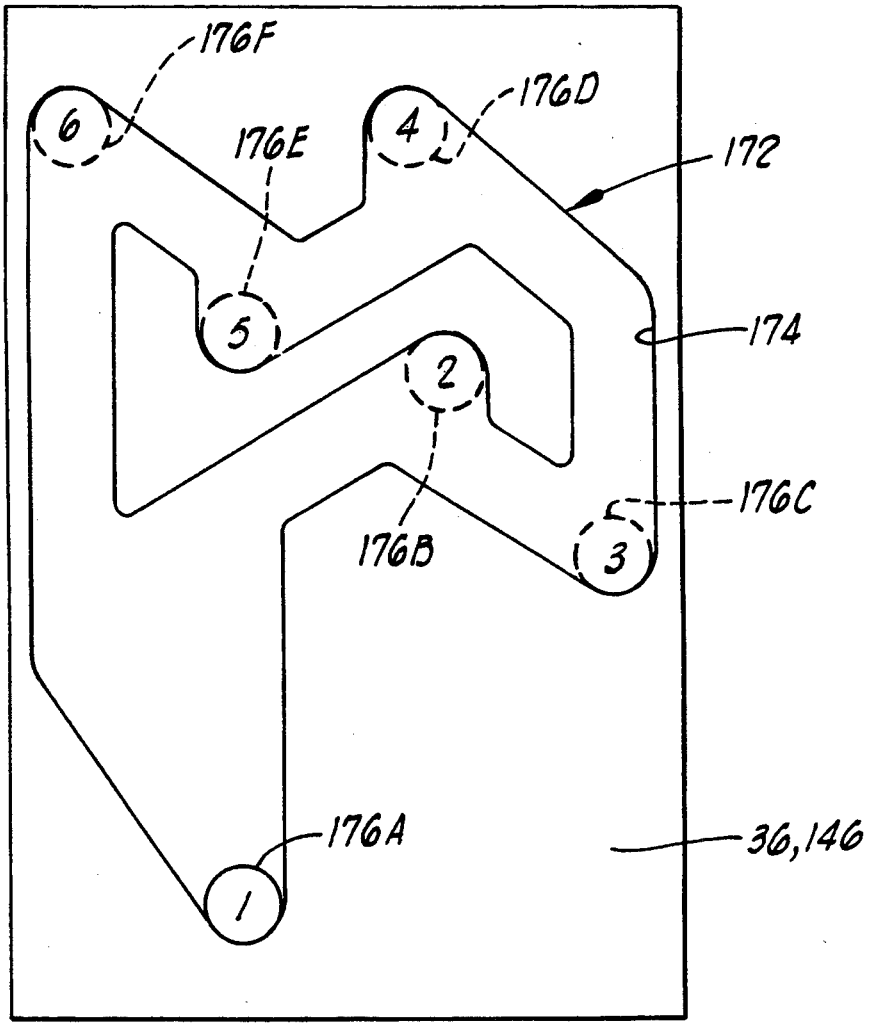
FIG. 4 is a laid-out view of the J-slot showing the pattern of positions of the lug within the J-slot.

The circulating/inflating position of straddle packer apparatus 10 is defined by the lug and J-slot means 172 by position 176A of lug 176 seen in FIG. 4. In this position, the mandrel 36 is in its telescopingly extended-most position relative to housing 34, which is maintained by the biasing force of spring 171 as the apparatus 10 is run into the well 12, to prevent premature telescoping collapse of the mandrel 36 within the housing 34.

Operation Of The Invention

The packer apparatus 10 is run into the well 12 in the circulating/inflating position of FIGS. 3A–3P. As packer apparatus 10 is run into the well 12, fluid may be circulated down bore 185 of mandrel 36 and out lower circulating ports 324, valve ports 348 and lower circulating passages 330 into the well annulus. Thus, circulating means 324, 348, 330 allows circulating of fluid through packer apparatus 10 as it is being positioned in the well 12.

After the apparatus 10 has been positioned as illustrated in FIG. 1, inflation fluid is pumped down the coiled tubing 32 to close circulation valve 45 and inflate the packers 40 and 42 as shown in FIG. 2. Fluid pumped down the coiled tubing 32 into straddle packer apparatus 10 will initially flow through lower circulating means 324, 348, 330 into the well annulus. However, as more fluid is pumped, pressure differential acting against the differential area between first outer surface 338 and second outer surface 342 on valve sleeve 336 will cause the valve sleeve to be moved downwardly, overcoming the force of valve spring 356 and compressing it. That is, the differential pressure used to close circulation valve 45 is created by the fluid flow rate through the restriction of lower circulating means 324, 348, 330. As the valve sleeve 336 moves downwardly, fluid below it is at least partially displaced through lower fluid relief ports 326, so that there can be no pressure buildup.

Counterbore 344 is larger than the outside diameter of intermediate seal 350, so the intermediate seal will not sealingly engage the counterbore. Intermediate seal 350 will come in contact with chamfer 346 and be gradually brought into sealing contact with bore 334 in valve case 306, thus isolating valve ports 348 from lower circulating passages 330. In this position, circulation valve 45 is closed. Thereafter, inflation fluid pumped down the coiled tubing 32 will cause packers 40 and 42 to be inflated. Once the packers 40 and 42 are inflated, the housing 34 is anchored in place relative to the well 12, and any further reciprocation of the coiled tubing 32 will act to reciprocate the mandrel 36 within the housing 34 as permitted by the lug and J-slot means 172.

After the packers 40 and 42 have been inflated as shown in FIG. 2, weight is set down on the apparatus 10 by slacking off on the coiled tubing 32 thus telescoping the mandrel 36 downward into the housing 34 until the lug 176 reaches intermediate position 176B as seen in FIG. 4.

As the mandrel 36 moves downward from the inflating position of FIGS. 3A–3P toward the intermediate position, the upper and lower inflation ports 188 and 192 are isolated from the upper and lower inflation passages 200 and 218 as the inflation ports 188 and 192 move below O-ring seals 246 and 248, respectively.

As the mandrel 36 is moved downward from the inflating position of FIGS. 3A–3P toward the intermediate position, flange 362 on valve mandrel 314 will be brought into engagement with upper end 352 of valve sleeve 336, thus physically holding the valve sleeve in its closed position. That is, regardless of the pressure differential between the inside of the packer apparatus 10 and the well annulus, circulation valve 45 is closed in the intermediate position.

By again picking up weight on coiled tubing 32, the mandrel 36 is telescopingly moved upwardly with respect to the housing 34 until the lug 176 reaches position 176C as shown in FIG. 4. This corresponds to a second circulating position of packer apparatus 10. In this second circulating position, upper and lower inflation ports 188 and 192 are still isolated from the upper and lower inflation passages 200 and 218 because ports 188 and 192 are still below O-ring seals 246 and 248, respectively. Also in the circulating position, flange 362 on valve mandrel 314 of mandrel 36 is still engaged with upper end 352 of valve sleeve 336 and thereby still holding the valve sleeve in a closed position. Further, in this circulating position, upper circulating ports 186 in mandrel 36 are moved below O-ring 242 and into communication with upper circulating passage 196 in housing 34. In the second circulating position, circulation may be carried out above set packers 40 and 42 through upper circulating means 186, 196.

After the desired circulation has been carried out, weight is again set down on the apparatus 10 by slacking off on the coiled tubing 32, thus telescoping the mandrel 36 downward into the housing 34 until the lug 176 reaches position 176D as seen in FIG. 4. This corresponds to a treating position of apparatus 10, which will be further described below as also identical to a ready position. It will be seen that this position results in further downward movement of mandrel 36 such that the treating ports 190 thereof are moved below O-ring 236 and into communication with the treating fluid passages 214 of housing 34. This additional downward movement of mandrel 36 also maintains valve sleeve 336 of circulation valve 45 in the closed position.

In the treating position, the upper equalizing ports 186 are moved below the upper equalizing passages 196 and isolated therefrom by O-ring 244 (see FIG. 3D). Also, the lower equalizing ports 194 are isolated from lower equalizing passages 234 by O-ring 247 (see FIG. 3J).

When the packer apparatus 10 is in the treating position, treating fluid is pumped down the coiled tubing 32 and through the mandrel 36 out the treating ports 190 and through the treating fluid passages 214 into the isolated zone 44 defined between the upper and lower packers 40 and 42. The treating fluid can be squeezed through the perforations 30 into the formation 26 to treat that formation.

After the treating operation is completed, weight is picked up from the apparatus 10 by picking up on the coiled tubing 32 and the mandrel 36 moves upward a relatively small distance until the lug 176 reaches position 176E as shown in FIG. 4. This is an equalizing position, where the isolated zone 44 remains in communication with the mandrel bore 185 through the treating fluid passages 214 and treating fluid ports 190 which are still in communication therewith. Also, an annulus 254 (see FIG. 2) of the well 12 defined between the tubing string 32 and well casing 14 above the upper packer 40, and the interior 28 of the production casing 14 below the lower packer 42 are communicated with the mandrel bore 185 through the upper and lower equalizing passages 196 and 234 which are aligned with the upper and lower equalizing ports 186 and 194, respectively, of mandrel 36.

With the packer apparatus 10 in the equalizing position, fluid pressure from the isolated zone 44 is allowed to equalize with fluid pressure in the annulus 252 above upper packer 40 and in the interior 28 of production casing 14 below the lower packer 42, so as to eliminate any substantial differential pressures across the upper and lower inflatable packers 40 and 42. The purpose of this is to avoid damage to the upper and lower inflatable packers 40 and 42 as they are subsequently deflated and moved to another position, in order to allow them to be reused a number of times without removing the apparatus 10 from a well.

After sufficient time has passed to allow pressures across the packers 40 and 42 to equalize, the coiled tubing 32 is again lowered to set down weight on the apparatus 10 and index the lug 176 to position 176F of FIG. 4, which is referred to as a ready position. The telescoping position of mandrel 36 relative to housing 34 in the ready position represented by lug position 176F is in fact identical to the telescoping position of mandrel 36 relative to housing 34 in the treating position represented by lug position 176D.

Then, to deflate the inflatable packers 40 and 42, weight is again picked up from the apparatus 10 by lifting on the coiled tubing 32 thus returning the lug 176 to a position within J-slot 174 corresponding to its initial position 176A, thus returning the straddle packer apparatus 10 to the relative position shown in FIGS. 3A–3P and bringing the inflation ports 188 and 192 back into communication with the inflation passages 200 and 218.

If packer apparatus 10 is run into the well bore without a check valve positioned thereabove, circulation valve 45 may act as a fill-up valve for filling the tool. Therefore, circulation valve 45 may also be referred to as a fill-up valve 45.

Frequently, however, packer apparatus 10 is run into the well-bore with a check valve (not shown) positioned thereabove. Such a check valve does not allow pressure to bleed off and deflate the packers 40 and 42. However, when packer apparatus 10 is returned to the position shown in FIGS. 3A–3P, the flange 362 of valve mandrel 314 of mandrel 36 is moved up so that it no longer engages upper end 352 of valve sleeve 336. Valve spring 356 returns valve sleeve 336 to the open position shown in FIGS. 3M and 3N. As the valve sleeve 336 moves upwardly, fluid may be at least partially displaced through upper fluid relief ports 322 so that there is no pressure buildup. Thus, packers 40 and 42 may bleed into bore 185 of mandrel 36 and out into the well annulus through the lower circulating means consisting of lower circulating ports 324, valve ports 348, and lower circulating passages 330, thus deflating the packers. In this way, circulation valve 45 may also be referred to as a deflation valve 45.

Then, the straddle packer apparatus 10 can be relocated to another position within the well 12 and the cycle can be repeated to again inflate the packers, circulate and treat another isolated zone of the well 12.

Referring to FIG. 4, a laid-out view is thereshown of the J-slot 174 of mandrel 36, with the six positions of lug 176 being shown in dashed lines and designated as 176A–176F as previously described.

Thus, the lug and J-slot means 172 defines a repeatable pattern of telescopingly reciprocating movement of the mandrel 36 relative to the housing 34. It can be further characterized as defining a repeating pattern of positions of mandrel 36 relative to the housing 34, said pattern including a sequence of inflating position, intermediate position, circulating position, treating position, equalizing position, and ready position wherein the next telescoping stroke of the mandrel 36 relative to the housing 34 will return the apparatus 10 to the deflating position, and subsequently, the inflating position of FIGS. 3A–3P.

In general terms, the mandrel 36 and the lug and J-slot means 172 can be jointly referred to as a control means 36, 172 operably associated with the housing 34 for defining a plurality of operating positions of the packer apparatus 10. The mandrel bore 185 of that portion of mandrel 36 contained within the housing 34 can also be generally referred to as defining at least a portion of the interior of the housing 34.

The present invention also encompasses methods of utilizing the apparatus just described.

A method of treating the subsurface zone 26 of well 12 having the well casing 14 with the production tubing 20 in place within the casing 14 can be described as follows.

First, a packer apparatus 10, such as a straddle packer having upper and lower inflatable packers 40 and 42 with a treating fluid passage outlet 216 located therebetween, is provided.

The packer apparatus 10 is lowered on a working tubing, preferably coiled tubing 32, down through production tubing 20 to a position below the lower end 24 of production tubing 20. As packer apparatus 10 is lowered, circulation may be carried out through lower circulating means 324, 348, 330. The packer apparatus 10 is placed adjacent the subsurface zone 26 which is to be treated as shown in FIG. 1.

Then inflation fluid is pumped down through the bore of the coiled tubing 32 thereby using fluid flow to close circulation valve 45 and inflating the upper and lower packers 40 and 42 as shown in FIG. 2 to seal the packers 40 and 42 against the production casing 14 to isolate a zone 44 of the well corresponding to and in communication with the subsurface formation 26.

Weight is then set down on the packer apparatus 10 with the coiled tubing 32 without rotating the coiled tubing 32, thus moving the packer apparatus to the intermediate position and thereby physically locking circulation valve 45 closed and trapping the inflation fluid in the inflatable packers 40 and 42.

Then, weight is picked up on the packer apparatus 10 with the coiled tubing 32 without rotating the coiled tubing 32, thus moving the packer apparatus to the second circulating position while still trapping the inflation fluid in the inflatable packers 40 and 42 and allowing circulation of fluid by placing circulating passage 196 in communication with the bore of the coiled tubing.

Weight is then set down on the packer apparatus 10 with the coiled tubing 32 without rotating the coiled tubing 32, thus moving the packer apparatus 10 to the treating position and placing the treating fluid passage outlet 216 of the packer apparatus 10 in communication with the bore of the coiled tubing 32.

Then treating fluid is pumped down through the bore of the coiled tubing 32 to treat the isolated zone 40 and thus the subsurface formation 26 of the well 12.

Then weight is picked up from the packer apparatus 10 with the coiled tubing 32 without rotating the coiled tubing 32 to communicate the isolated zone 44 of the well 12 through the packer apparatus 10 with the annulus 252 above upper packer 40 and with the interior 28 of casing 14 below the lower packer 42 thus equalizing pressure across the inflated packers 40 and 42 prior to deflation of the same.

Subsequently, weight is again set down on the packer apparatus 10 with the coiled tubing 32 to index the lug to the ready position 176F, and weight is then again picked up with the coiled tubing 32 to return the packer apparatus 10 to the circulating/inflating position of FIGS. 3A–3P thus communicating the inflation passages of the housing 34 with the bore of the coiled tubing 32 and unlocking circulation valve 45, thereby deflating the upper and lower packers 40 and 42 through the valve 45 to unseat the packers from the production casing 22.

The packer apparatus 10 can then be relocated to another position within the well 12 and the cycle repeated to treat another zone of the well.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A packer apparatus for use on coiled tubing in a well bore, said apparatus comprising:

a housing having a central housing opening and defining a circulating passage therethrough;

a packer element mounted on said housing;

a valve sleeve slidably disposed in said housing, said valve sleeve defining a valve port therethrough in communication with said circulating passage when said valve sleeve is in an open position, thereby allowing circulation, and isolated from said circulating passage when in a closed position, thereby preventing circulation, said valve sleeve defining a differential area thereon such that a predetermined fluid flow through the apparatus results in sufficient pressure acting across said differential area to move said valve sleeve to said closed position without requiring rotation of the tubing, wherein said valve sleeve is adapted for allowing circulation of fluid after said packer element is engaged with said well bore; and a mandrel disposed in said central opening and defining a circulating port therein, said circulating port and circulating passage being in communication when said mandrel is in a circulating position with respect to said housing.

2. The apparatus of claim 1 further comprising biasing means for biasing said sleeve toward said open position.

3. The apparatus of claim 2 wherein said biasing means is characterized by a spring.

4. The apparatus of claim 1 wherein said packer is a straddle packer and said packer element is one of a plurality of longitudinally spaced packers.

5. The apparatus of claim 1 wherein said packer element is an inflatable packer element.

6. The apparatus of claim 1 wherein said valve sleeve is adapted for allowing circulation of fluid as the apparatus is run into the well bore.

7. A packer apparatus comprising:

a housing having a central housing opening, and having packer inflation passage means defined in said housing, and having a treating fluid passage defined in said housing with an outlet of said treating fluid passage communicating with an exterior of said housing;

a packer mounted on said housing adjacent to said outlet of said treating fluid passage, said packer being in communication with said packer inflation passage means;

an inner mandrel slidably received in said central housing opening, said mandrel having a mandrel bore and having an inflation port means and a treating port means, each communicated with said mandrel bore;

circulating means for circulating fluid from said central housing opening through said housing into a well annulus, said circulating means being open as the apparatus is run into a well bore; and lug and J-slot means, operably associated with said housing and said inner mandrel, for controlling a telescoping position of said mandrel relative to said housing in response to telescoping reciprocation without rotation of said mandrel relative to said housing, said mandrel being movable between an inflating position wherein said inflation port means of said mandrel is communicated with said inflation passage means of said housing and said treating port means of said mandrel is isolated from said treating passage means of said housing, a circulating position in which said circulating means is open, and a treating position wherein said inflation port means of said mandrel is isolated from said inflation passage means of said housing and said treating port means of said mandrel is communicated with said treating fluid passage of said housing.

8. The apparatus of claim 7 further comprising spring biasing means, operably associated with said housing and said mandrel, for biasing said mandrel telescopingly outwardly relative to said housing.

9. The apparatus of claim 7 wherein said lug and J-slot means comprises:

a slot means defined on and longitudinally movable with one of said housing and said mandrel;

a lug means defined on and longitudinally movable with the other of said housing and said mandrel, said lug means being received in said slot means to define an endlessly repeating pattern of telescopingly reciprocating movement of said mandrel relative to said housing; and one of said slot means and said lug means being defined on a rotating body rotatably mounted on a respective one of said mandrel and said housing to permit relative rotational motion between said slot means and said lug means about a longitudinal axis of said housing without having relative rotational movement between said mandrel and said housing.

10. The apparatus of claim 9 wherein said slot means is defined on said mandrel.

11. The apparatus of claim 7 wherein:

said packer is one of upper and lower longitudinally spaced packers mounted on said housing on opposite sides of said outlet of said treating fluid passage;

said inflation passage means includes separate upper and lower inflation passages defined in said housing and communicated with said upper and lower packers, respectively; and said inflation port means includes separate upper and lower inflation ports arranged to communicate said mandrel bore with said upper and lower inflation passages, respectively, when said mandrel is in said inflating position.

12. The apparatus of claim 7 wherein said circulating means comprises a circulating port defined in said mandrel and a circulating passage defined in said housing, said circulating port and said circulating passage being arranged to communicate said mandrel bore with the well annulus when said circulating means is open.

13. The apparatus of claim 7 wherein said circulating means is characterized by a circulation valve.

14. A packer apparatus for use on coiled tubing in a well bore, said apparatus comprising:

a housing having a central housing opening and defining a circulating passage therethrough;

a valve sleeve slidably disposed in said housing, said valve sleeve defining a valve port therethrough in communication with said circulating passage when said valve sleeve is in an open position, thereby allowing circulation, and isolated from said valve port when in a closed position, thereby preventing circulation;

a mandrel telescopingly disposed in said central housing opening, said mandrel having means for holding said valve sleeve in said closed position;

a packer element mounted on said housing; and resettable circulating means for allowing circulation of fluid from said central housing opening through said housing into a well annulus without rotation of the tubing.

15. The apparatus of claim 14 wherein said means for holding is characterized by a flange on said mandrel adapted for engaging said valve sleeve.

16. A packer apparatus comprising:

a housing having a central housing opening, and having packer inflation passage means defined in said housing, and having a treating fluid passage defined in said housing with an outlet of said treating fluid passage communicating with an exterior of said housing;

a packer mounted on said housing adjacent to said outlet of said treating fluid passage, said packer being in communication with said packer inflation passage means;

an inner mandrel slidably received in said central housing opening, said mandrel having a mandrel bore and having an inflation port means and a treating port means, each communicated with said mandrel bore;

circulating means for circulating fluid from said central housing opening through said housing into a well annulus; and lug and J-slot means, operably associated with said housing and said inner mandrel, for controlling a telescoping position of said mandrel relative to said housing in response to telescoping reciprocation without rotation of said mandrel relative to said housing, said mandrel being movable between an inflating position wherein said inflation port means of said mandrel is communicated with said inflation passage means of said housing and said treating port means of said mandrel is isolated from said treating passage means of said housing, a circulating position in which said circulating means is open, and a treating position wherein said inflation port means of said mandrel is isolated from said inflation passage means of said housing and said treating port means of said mandrel is communicated with said treating fluid passage of said housing;

wherein:

said housing has an equalizing passage means defined therein communicated with the exterior of said housing above said packer and communicated with the exterior of said housing below said packer;

said packer has an equalizing port means defined therein communicated with said mandrel bore; and said lug and J-slot means further defines an equalizing position of said mandrel wherein said equalizing port means of said mandrel communicates with said equalizing passage means of said housing with said mandrel bore while said treating fluid passage is also communicated with said mandrel bore through said treating port means.

17. The apparatus of claim 16 wherein said lug and J-slot means is further characterized as defining a repeatable pattern of positions of said mandrel relative to said housing, said pattern including a repetitive sequence of inflating position, circulating position, treating position, equalizing position and ready position, wherein said ready position is such that upon the next telescoping stroke of said mandrel relative to said housing, said mandrel returns to said inflating position.

18. The apparatus of claim 17 wherein said lug and J-slot means is further characterized in that said mandrel telescopes inwardly from said inflating position to an intermediate position, then outwardly to said circulating position, then inwardly to said treating position, then outwardly to said equalizing position, then inwardly to said ready position, then outwardly to said inflating position.

19. The apparatus of claim 17 wherein the telescoping position of said mandrel relative to said housing in said treating position is substantially identical to the telescoping position of said mandrel relative to said housing in said ready position.

20. A packer apparatus comprising:

a housing having a central housing opening, and having packer inflation passage means defined in said housing, and having a treating fluid passage defined in said housing with an outlet of said treating fluid passage communicating with an exterior of said housing;

a packer mounted on said housing adjacent to said outlet of said treating fluid passage, said packer being in communication with said packer inflation passage means;

an inner mandrel slidably received in said central housing opening, said mandrel having a mandrel bore and having an inflation port means and a treating port means, each communicated with said mandrel bore;

circulating means for circulating fluid from said central housing opening through said housing into a well annulus, said circulating means being characterized by a circulation valve comprising:

a portion of said inner mandrel defining a circulating port therethrough;

a portion of said housing defining a circulating passage therethrough; and a valve sleeve slidably disposed between said housing and said mandrel and having a valve port defined therethrough, said valve port being in communication with said circulating passage when in an open position and isolated from said circulating passage when in a closed position; and lug and J-slot means, operably associated with said housing and said inner mandrel, for controlling a telescoping position of said mandrel relative to said housing in response to telescoping reciprocation without rotation of said mandrel relative to said housing, said mandrel being movable between an inflating position wherein said inflation port means of said mandrel is communicated with said inflation passage means of said housing and said treating port means of said mandrel is isolated from said treating passage means of said housing, a circulating position in which said circulating means is open, and a treating position wherein said inflation port means of said mandrel is isolated from said inflation passage means of said housing and said treating port means of said mandrel is communicated with said treating fluid passage of said housing.

21. The apparatus of claim 20 wherein:

said valve sleeve has a first outer surface and a smaller second outer surface such that a differential area is defined on the valve sleeve; and a predetermined pressure acting across said differential area will move said valve sleeve to said closed position.

22. The apparatus of claim 20 further comprising biasing means for biasing said valve sleeve toward said open position.

23. The apparatus of claim 22 wherein said biasing means is characterized by a valve spring.

24. The apparatus of claim 20 further comprising means for holding said valve sleeve in said closed position.

25. The apparatus of claim 24 wherein said means for holding is characterized by a flange extending from said mandrel and adapted for engaging a portion of said valve sleeve.

* * * * *